US010161673B2

(12) United States Patent
Yamato et al.

(10) Patent No.: US 10,161,673 B2
(45) Date of Patent: Dec. 25, 2018

(54) REFRIGERATOR AND HOUSEHOLD APPLIANCE NETWORKING SYSTEM

(71) Applicant: Mitsubishi Electric Corporation, Tokyo (JP)

(72) Inventors: Yasunari Yamato, Tokyo (JP); Go Maeda, Tokyo (JP); Makoto Okabe, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 99 days.

(21) Appl. No.: 14/893,141

(22) PCT Filed: Jul. 28, 2014

(86) PCT No.: PCT/JP2014/069871
§ 371 (c)(1),
(2) Date: Nov. 23, 2015

(87) PCT Pub. No.: WO2015/019892
PCT Pub. Date: Feb. 12, 2015

(65) Prior Publication Data

US 2016/0116207 A1 Apr. 28, 2016

(30) Foreign Application Priority Data

Aug. 9, 2013 (JP) ..... 2013-166296

(51) Int. Cl.
*A47B 81/00* (2006.01)
*F25D 29/00* (2006.01)
(Continued)

(52) U.S. Cl.
CPC ..... *F25D 29/00* (2013.01); *A47B 81/00* (2013.01); *A47B 81/06* (2013.01);
(Continued)

(58) Field of Classification Search
USPC ..... 236/51
See application file for complete search history.

(56) References Cited

U.S. PATENT DOCUMENTS 7,155,923 B2 * 1/2007 Nam ..... F25D 29/005 165/80.3
8,106,539 B2 * 1/2012 Schatz ..... B60L 11/007 307/104
(Continued)

FOREIGN PATENT DOCUMENTS

JP 2003-097884 A 4/2003
JP 2003-224891 A 8/2003
(Continued)

OTHER PUBLICATIONS

Office Action dated Nov. 14, 2016 issued in corresponding CN patent application No. 201480044483.3 (and English translation).
(Continued)

*Primary Examiner* — David Teitelbaum
*Assistant Examiner* — Paul Schwarzenberg
(74) *Attorney, Agent, or Firm* — Posz Law Group, PLC

(57) ABSTRACT

A refrigerator includes a casing including storage compartments, doors attached to the casing to expose or cover the storage compartments, hinges connecting the doors to the casing and supporting the doors so that the doors are openable and closable, electrically non-conductive hinge covers detachably attached to the casing and covering the hinges, and a wireless adapter disposed on the hinge cover and including an antenna unit configured to transmit and receive radio waves.

10 Claims, 9 Drawing Sheets

(51) Int. Cl.

| | |
|---|---|
| ***A47B 81/06*** | (2006.01) |
| ***F25D 23/02*** | (2006.01) |
| ***F25D 27/00*** | (2006.01) |
| ***E05D 11/00*** | (2006.01) |
| *E05D 9/00* | (2006.01) |

(52) U.S. Cl.

CPC ..... *E05D 11/0054* (2013.01); *F25D 23/028* (2013.01); *F25D 27/00* (2013.01); *E05D 9/005* (2013.01); *E05Y 2400/10* (2013.01); *E05Y 2400/452* (2013.01); *E05Y 2400/66* (2013.01); *E05Y 2800/676* (2013.01); *E05Y 2900/31* (2013.01); *F25B 2600/07* (2013.01); *F25D 29/005* (2013.01); *F25D 2323/024* (2013.01); *F25D 2600/00* (2013.01); *F25D 2700/04* (2013.01)

(56) References Cited

U.S. PATENT DOCUMENTS

| | | | | |
|---|---|---|---|---|
| 2008/0164224 | A1* | 7/2008 | McCoy | H01R 31/06 211/26.1 |
| 2008/0203874 | A1* | 8/2008 | Lim | E05D 11/0054 312/404 |
| 2009/0193823 | A1* | 8/2009 | Lee | F25D 23/12 62/125 |
| 2011/0085287 | A1* | 4/2011 | Ebrom | G08C 17/02 361/679.01 |
| 2013/0098083 | A1* | 4/2013 | Kong | F25D 29/00 62/129 |

FOREIGN PATENT DOCUMENTS

| | | | | |
|---|---|---|---|---|
| JP | 2005-140345 | A | | 6/2005 |
| JP | 2005140345 | A | * | 6/2005 |
| JP | 2005-315479 | A | | 11/2005 |
| JP | 2006-050524 | A | | 2/2006 |
| JP | 2006-054834 | A | | 2/2006 |
| JP | 2006-071172 | A | | 3/2006 |
| JP | 2006-084132 | A | | 3/2006 |
| JP | 2006071172 | A | * | 3/2006 |
| JP | 4284534 | B2 | | 4/2009 |
| JP | 2009-124895 | A | | 6/2009 |
| JP | 2011-141067 | A | | 7/2011 |
| WO | 2008/004732 | A1 | | 1/2008 |

OTHER PUBLICATIONS

International Search Report of the International Searching Authority dated Oct. 28, 2014 for the corresponding international application no. PCT/JP2014/069871 (and English translation).

Australian Office Action dated Jun. 8, 2016 in the corresponding Australian application No. 2014303704.

Japanese Office Action dated Aug. 16, 2016 in the corresponding JP application No. 2013-166296 ( English translation attached ).

Communication Pursuant to Article 164(1) EPC dated Feb. 10, 2017 by the European Patent Office in corresponding European Patent Application No. 14835174.5.

Extended European Search Report dated Apr. 25, 2017 in the corresponding EP Patent Application No. 14835174.5.

* cited by examiner

REFRIGERATOR AND HOUSEHOLD APPLIANCE NETWORKING SYSTEM

CROSS REFERENCE TO RELATED APPLICATIONS

This application is a U.S. national stage application of International Application No. PCT/JP 2014/069871 filed on Jul. 28, 2014, which claims priority to Japanese Patent Application No. 2013-166296 filed on Aug. 9, 2013, the disclosures of which are incorporated herein by reference.

TECHNICAL FIELD

The present invention relates to a refrigerator with a wireless adapter including an antenna unit for transmitting and receiving radio waves and a household appliance networking system connected to the refrigerator.

BACKGROUND ART

Energy saving has recently been receiving increasing attention from the viewpoint of global environment protection. Attention is being focused on a power management system, such as a home energy management system (HEMS), for managing power on a house-by-house basis. The HEMS interactively connects household appliances arranged in a house via an information network to control, for example, optimization of power consumption. A technique for connecting a household appliance, for example, a refrigerator, to such an information network is described in Patent Literature 1.

Patent Literature 1 discloses a refrigerator having a top surface on which a communication board including an antenna unit for transmitting and receiving radio waves is mounted. As described in Patent Literature 1, the communication board is mounted on the top surface of the refrigerator so that the antenna unit of the communication board is disposed 3 cm or more apart from a magnet disposed inside a gasket attached to a door of the refrigerator. This arrangement prevents interference of the magnet with radio wave transmission and reception of the antenna unit in this related art. In Patent Literature 1, a line connecting the communication board that controls the refrigerator to a main board is embedded in a thermally insulated box (casing) of the refrigerator. Patent Literature 2 discloses an information processing apparatus having as a communication network adapter provided with a light, a camera, or a human presence sensor.

CITATION LIST

Patent Literature

Patent Literature 1: Japanese Unexamined Patent Application Publication No. 2005-140345 (claim 1, FIGS. 2 and 3)

Patent Literature 2: Japanese Unexamined Patent Application Publication No. 2006-54834 (claims 12 and 14, paragraph 0053)

SUMMARY OF INVENTION

Technical Problem

The refrigerator disclosed in Patent Literature 1, however, fails to provide a sufficient distance between the communication board and a top surface of the refrigerator. The top surface of the refrigerator is typically formed of a steel sheet. This steel sheet affects radio waves transmitted and received by the antenna unit included in the communication board, thus attenuating the intensity of radio waves. In addition, the line connecting the communication board to the main board is previously embedded in the casing, but the line is unnecessary for a user who does not connect the refrigerator to an information network, leading to an increased cost.

Furthermore, any consideration is not given to radio interference in Patent Literature 2.

The present invention has been made in consideration of the above-described problems and provides a refrigerator that reduces or eliminates interference with radio waves and a household appliance networking system connected to the refrigerator.

Solution to Problem

A refrigerator according to the present invention including a casing having a storage compartment, a door attached to the casing to expose or cover the storage compartment, a hinge connecting the door to the casing and supporting the door so that the door is openable and closable, a an electrically non-conductive hinge cover detachably attached to the casing and covering the hinge, and a wireless adapter disposed on the hinge cover and including an antenna unit configured to transmit and receive radio waves.

Advantageous Effects of Invention

According to the present invention, the wireless adapter is disposed on the hinge cover. Even when the casing is formed of a steel sheet, this arrangement can provide a sufficient distance between the steel sheet and the wireless adapter. Consequently, the wireless adapter mounted on the refrigerator can perform stable radio communication.

DESCRIPTION OF EMBODIMENT

Embodiments of a refrigerator and a household appliance networking system according to the present invention will be described with reference to the drawings. Embodiments, which will be described below, should not be construed as limiting the present invention. Note that the dimensional relationship among components in FIG. 1 and subsequent figures may be different from the actual relationship.

Embodiment 1

Figure 1:
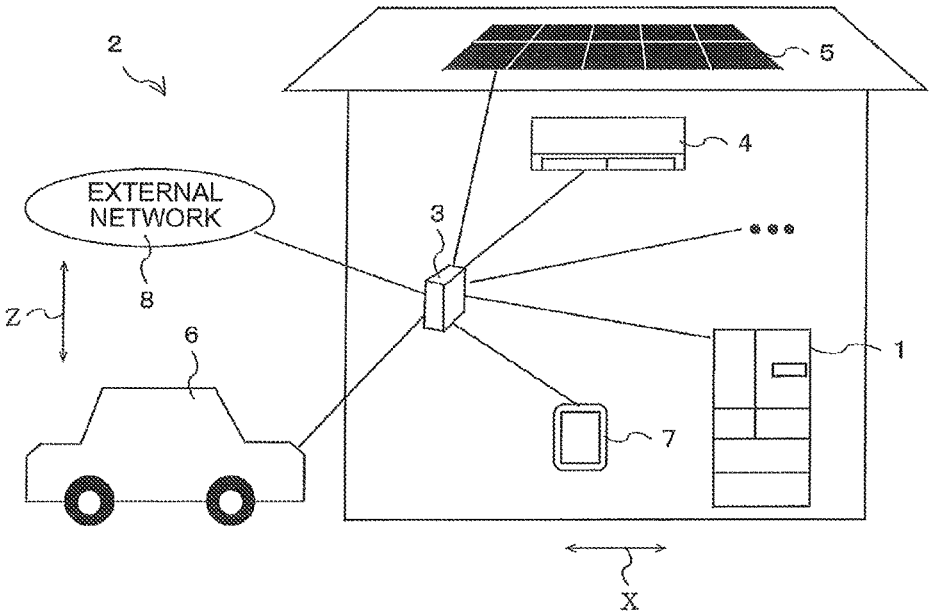
FIG. 1 is a schematic diagram illustrating a household appliance networking system 2 according to Embodiment 1.

FIG. 1 is a schematic diagram illustrating a household appliance networking system 2 according to Embodiment 1. The household appliance networking system 2 will be described below with reference to FIG. 1. As illustrated in FIG. 1, the household appliance networking system 2 includes a central controller 3 and a plurality of electrical apparatuses connected to the central controller 3 in a wireless manner. The electrical apparatuses include household appliances, such as a refrigerator 1 and an air conditioning apparatus 4 arranged in a house. In addition to the household appliances, the central controller 3 is connected to photovoltaic panels 5 and an electric car 6. For example, the central controller 3 controls electric power loads in the house depending on power generation by the photovoltaic panels 5 or a charge state of the electric car 6. Additionally, the central controller 3 is connected to a stationary or tablet information terminal 7. A user can check the usage of electricity and operate the electrical apparatuses by using the information terminal 7 through the central controller 3.

Figure 2:
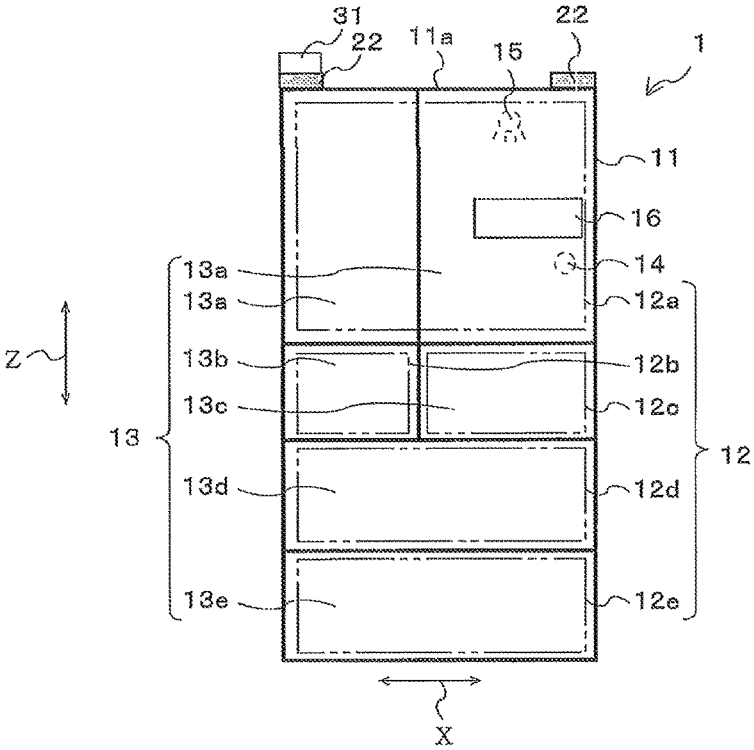
FIG. 2 is a front view of a refrigerator 1 according to Embodiment 1.
Figure 3:
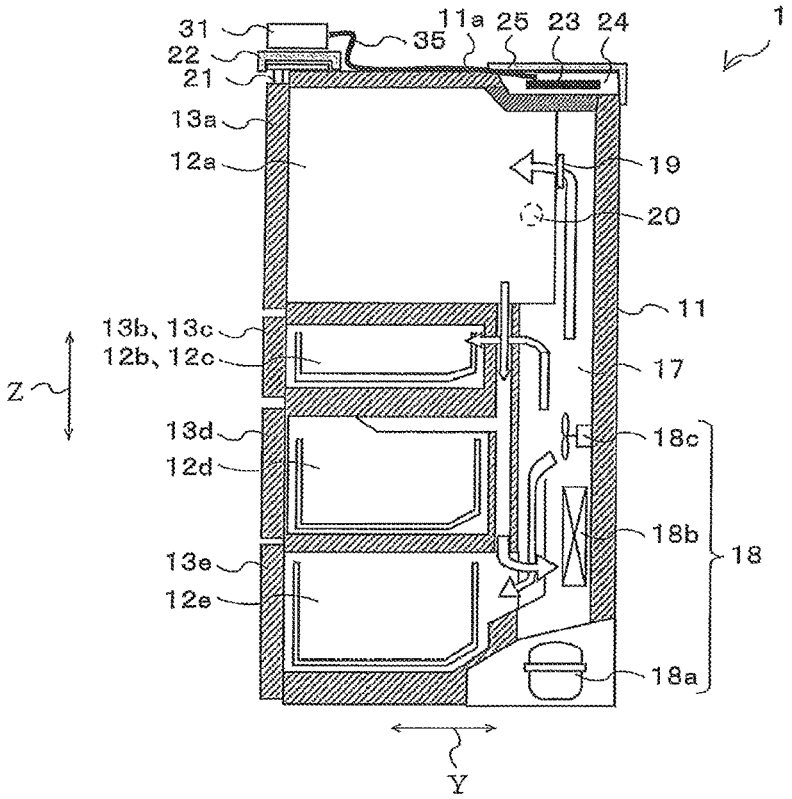
FIG. 3 is a sectional side view of the refrigerator 1 according to Embodiment 1.
Figure 4:
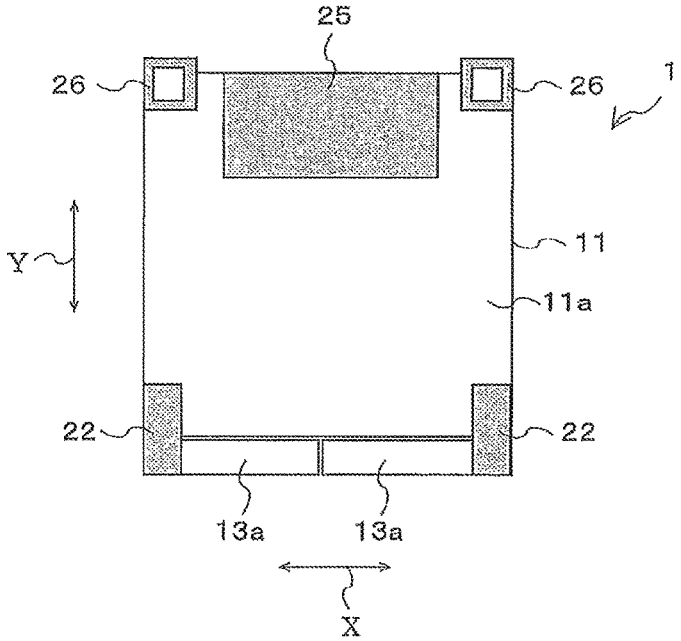
FIG. 4 is a top view of the refrigerator 1 according to Embodiment 1.

The central controller 3 is also connected to an external network 8, so that, for example, power supply information from an electric power company, weather or temperature information, and information necessary for control of the devices connected to the central controller 3 can be obtained. Furthermore, the central controller 3 transmits, for example, information indicating the usage of electricity or a device operation state via the external network 8 to a data server. Although the refrigerator 1, the air conditioning apparatus 4, the photovoltaic panels 5, the electric car 6, and the information terminal 7 are connected to the central controller 3 in FIG. 1, FIG. 1 illustrates an example. The central controller 3 may be connected to other devices, for example, a water heater, a lighting device, and a television set. The central controller 3 may be connected to the other devices in a wired manner. The refrigerator 1 connected to the central controller 3 will be described below. FIG. 2 is a front view of the refrigerator 1 according to Embodiment 1, FIG. 3 is a sectional side view of the refrigerator 1 according to Embodiment 1, and FIG. 4 is a top view of the refrigerator 1 according to Embodiment 1. The refrigerator 1 will be described with reference to FIGS. 2 to 4. As illustrated in FIG. 2, the refrigerator 1 includes a casing 11 having storage compartments 12, and doors 13.

The storage compartments 12 includes a refrigerating compartment 12*a* disposed as a top compartment, an ice making compartment 12*b* and a first freezer compartment 12*c* arranged beneath the refrigerating compartment 12*a*, a second freezer compartment 12*d* disposed beneath the ice making compartment 12*b* and the first freezer compartment 12*c*, and a vegetable compartment 12*e* disposed as a bottom compartment. The doors 13 are opened or closed to expose or cover these storage compartments 12, and include refrigerating compartment doors 13*a*, an ice making compartment door 13*b*, a first freezer compartment door 13*c*, a second freezer compartment door 13*d*, and a vegetable compartment door 13*e*. The storage compartments 12 are provided with a door switch 14 for sensing opening and closing of the doors 13. In particular, when opening of any of the refrigerating compartment doors 13*a* is sensed in the refrigerating compartment 12*a*, a refrigerator light 15 disposed inside the refrigerating compartment 12*a* is turned on. In addition, one of the refrigerating compartment doors 13*a* is provided with an operation panel 16. For example, operating the operation panel 16 controls set temperatures of the storage compartments 12 and gives, for example, a rapid cooling instruction to the refrigerator 1.

As illustrated in FIG. 3, the casing 11 includes a cooling room 17 in addition to the storage compartments 12. In this cooling room 17, a cooling device 18 is disposed. The cooling device 18 includes a refrigeration cycle including a compressor 18*a*, a cooler 18*b*, an expansion unit (not illustrated), and a condenser, and a refrigerator fan 18*c*. The refrigerator fan 18*c* sends air produced by the refrigeration cycle to the storage compartments 12 through an air passage. In the air passage, an openable and closeable damper 19 is disposed. The damper 19 is opened or closed on the basis of a temperature in the storage compartments 12 sensed by a temperature sensor 20 disposed in the storage compartments 12. Opening and closing the damper 19 performs temperature control in the storage compartments 12. After cooled air is sent to the storage compartments 12, the air is returned to the cooler 18*b* and is again cooled. The cooled air is sent to the storage compartments 12 by the refrigerator fan 18*c*. The air is circulated in that manner.

The casing 11 is also provided with hinges 21 that support the refrigerating compartment doors 13*a* so that the doors are openable and closable. Each hinge 21 connects the refrigerating compartment door 13*a* to the casing 11. The hinge 21 is covered by an electrically non-conductive hinge cover 22. The hinge cover 22 is made of, for example, resin. The hinge cover 22 is detachably attached to a top surface 11*a* of the casing 11. A wireless adapter 31 is mounted on an upper surface of one of the hinge covers 22. The top surface 11*a* of the casing 11 has a stepped portion adjacent to a rear surface of the casing 11. The stepped portion serves as a board holder 24 for holding a control board 23 that controls the cooling device 18. The board holder 24 is covered by a board holder cover 25, thereby protecting the control board 23. The board holder cover 25 is made of, for example, metal.

As described above, the hinge covers 22 are attached to two corners of the top surface 11*a* of the casing 11 adjacent to the doors 13 as illustrated in FIG. 4. In addition, carrying handles 26 to be used for carrying the casing 11 are attached to two corners of the top surface 11*a* of the casing 11 adjacent to the rear surface of the casing 11. The carrying handles 26 are electrically non-conductive members made of, for example, resin. As described above, the board holder cover 25 is attached to the top surface 11*a* of the casing 11 adjacent to the rear surface of the casing 11.

Figure 5:
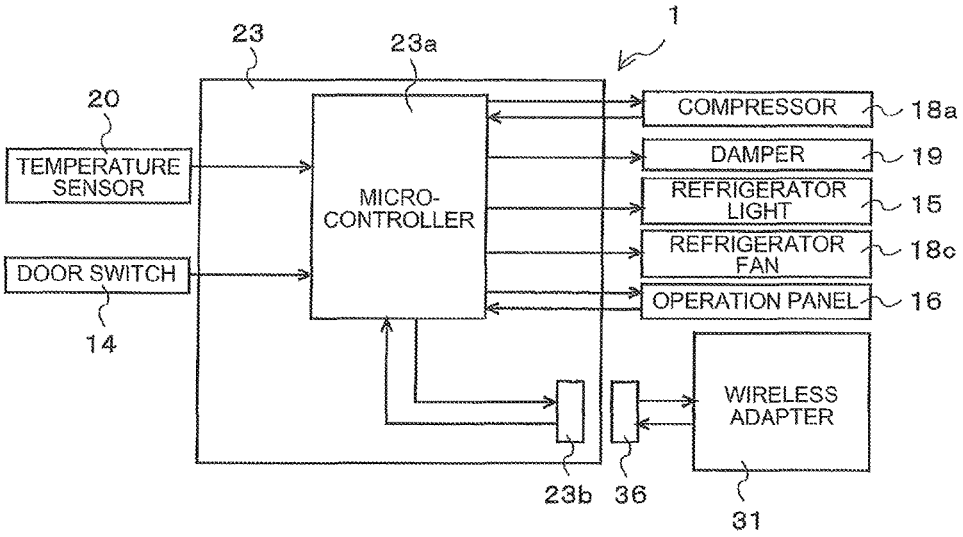
FIG. 5 is a block diagram of the refrigerator 1 according to Embodiment 1.

The control board 23 will be described below. FIG. 5 is a block diagram illustrating the refrigerator 1 according to Embodiment 1. The control board 23 includes a microcontroller 23*a* that controls the refrigerator 1. The microcontroller 23*a* receives input signals from, for example, the temperature sensor 20, the door switch 14, the compressor 18*a*, and the operation panel 16. In response to receiving the input signal from the temperature sensor 20, the microcontroller 23*a* determines, for example, a rotation speed of the compressor 18*a* on the basis of a temperature in the storage compartments 12 sensed by the temperature sensor 20, and transmits an output signal to the compressor 18*a*. Additionally, the microcontroller 23*a* outputs a signal for activating or stopping the refrigerator fan 18*c* and a signal for opening or closing the damper 19 disposed in the air passage to the refrigerator fan 18*c* and the damper 19 on the basis of the temperature in the storage compartments 12 sensed by the temperature sensor 20.

In response to receiving the input signal from the door switch 14, the microcontroller 23*a* transmits an output signal for displaying, for example, open and/or closed states of the doors 13 on the operation panel 16 to the operation panel 16. Additionally, the microcontroller 23*a* transmits an output signal for turning on the refrigerator light 15 disposed inside the storage compartments 12 to the refrigerator light 15 in response to receiving the input signal from the door switch 14. Furthermore, in response to receiving the input signal from the compressor 18*a*, the microcontroller 23*a* outputs a signal for activating or stopping the refrigerator fan 18*c* and a signal for opening or closing the damper 19 disposed in the air passage to the refrigerator fan 18*c* and the damper 19 on the basis of an operation state of the compressor 18*a*. Additionally, in response to receiving the input signal from the operation panel 16 generated by an operation on the operation panel 16, the microcontroller 23*a* transmits output signals to the components on the basis of the input signal. For example, when the operation panel 16 is operated to control a temperature in the storage compartments 12, the microcontroller 23*a* transmits an output signal to, for example, the compressor 18*a*, the refrigerator fan 18*c*, or the damper 19 on the basis of an input signal from the operation panel 16.

The control board 23 further includes a board connector 23*b* for connecting the wireless adapter 31 to the control board 23. An adapter connector 36 is attached to the wireless adapter 31. Connecting the adapter connector 36 to the board connector 23*b* connects the wireless adapter 31 to the control board 23. Thus, the refrigerator 1 including the control board 23 performs information communication with the central controller 3 via the wireless adapter 31.

Figure 6:
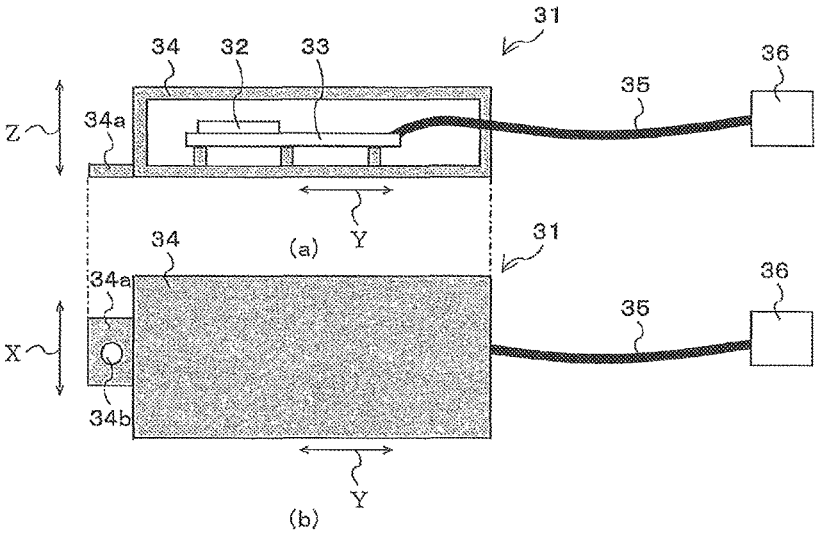
FIG. 6 includes schematic diagrams illustrating a wireless adapter 31 in Embodiment 1.

The wireless adapter 31 will be described below. In FIG. 6, parts (a) and (b) are schematic diagrams illustrating the wireless adapter 31 in Embodiment 1. FIG. 6 (a) is a sectional side view of the wireless adapter 31 and FIG. 6 (b) is a top view of the wireless adapter 31. As illustrated in FIG. 6 (a), the wireless adapter 31 includes an antenna unit 32 for transmitting and receiving radio waves. The antenna unit 32 is attached to a communication board 33. The communication board 33 is accommodated in a communication case 34 made of, for example, resin, and is connected to a communication line 35 extending from the adapter connector 36. As illustrated in FIG. 6 (b), the communication case 34 has a protrusion 34*a* having a screw hole 34*b*.

Figure 7:
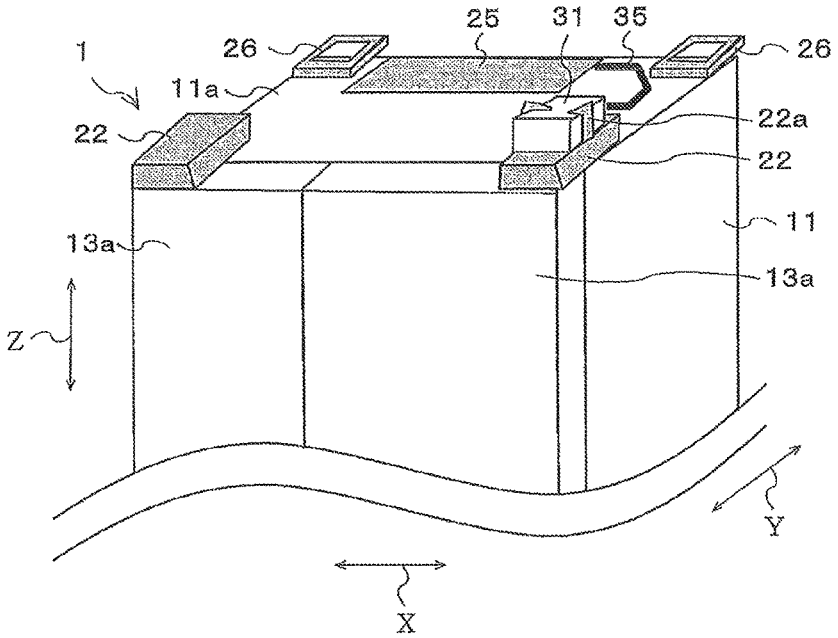
FIG. 7 is a perspective view of the refrigerator 1 according to Embodiment 1.
Figure 8:
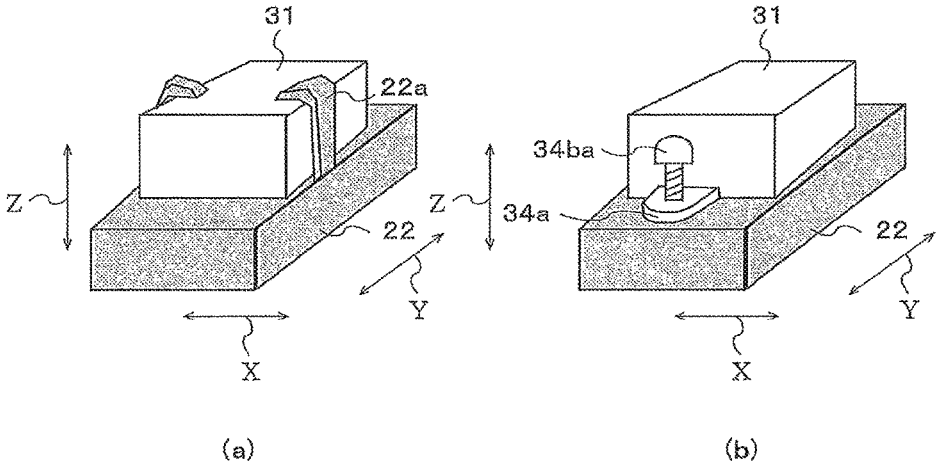
FIG. 8 includes perspective views illustrating the wireless adapter 31 in Embodiment 1.

The refrigerator 1 on which the wireless adapter 31 is mounted will be described below in detail. FIG. 7 is a perspective view of the refrigerator 1 according to Embodiment 1. In FIG. 8, parts (a) and (b) are perspective views illustrating the wireless adapter 31 in Embodiment 1. FIG. 8 (a) is a perspective view illustrating the wireless adapter 31 fastened with claws 22*a*. FIG. 8 (b) is a perspective view illustrating the wireless adapter 31 fastened with a screw 34*b a*. As illustrated in FIG. 7, the wireless adapter 31 is fastened to the upper surface of the hinge cover 22 disposed on the top surface 11*a* of the casing 11. As illustrated in FIG. 8 (a), the hinge cover 22 includes the claws 22*a* extending from the upper surface of the hinge cover 22 to tightly hold the wireless adapter 31. The wireless adapter 31 is fastened to the hinge cover 22 with the claws 22*a*.

As regards the manner of fastening the wireless adapter 31, as illustrated in FIG. 8 (b), the protrusion 34*a* of the communication case 34 of the wireless adapter 31 may be brought into contact with the hinge cover 22, and the screw 34*ba* extending through the screw hole 34*b* of the protrusion 34*a* may be screwed into the hinge cover 22 to fasten the wireless adapter 31 to the hinge cover 22. Alternatively, the wireless adapter 31 may be fixed to the hinge cover 22 with a double-faced tape. As illustrated in FIG. 7, the communication line 35 connecting the wireless adapter 31 to the adapter connector 36 extends from the wireless adapter 31 into the board holder cover 25 so that the communication line 35 is laid on the top surface 11*a* (shell) of the casing 11. The adapter connector 36 at the end of the communication line 35 is connected to the board connector 23*b* of the control board 23.

An operation of the refrigerator 1 according to Embodiment 1 will be described below. As described above, the wireless adapter 31 is fastened to the upper surface of the hinge cover 22 attached to the top surface 11*a* of the casing 11. For example, when the top surface 11*a* of the casing 11 is formed of a steel sheet, this arrangement can provide a sufficient distance between the steel sheet and the wireless adapter 31. Consequently, the influence of the steel sheet is reduced, so that the wireless adapter 31 mounted on the refrigerator 1 achieves stable radio communication.

The hinge covers 22 are provided for typical refrigerators 1 in most cases. In Embodiment 1, the wireless adapter 31 is mounted on the hinge cover 22. Since the hinge cover 22 is also used as a mounting component for the wireless adapter 31, the hinge cover 22 offers considerably enhanced versatility. Additionally, the hinge covers 22 are detachably attached to the casing 11. Before shipment from a factory, a hinge cover having no fastening structure, such as the claws 22*a*, for fastening the wireless adapter 31 may be attached to the casing 11. This hinge cover can be replaced by the hinge cover 22 having a structure for fastening the wireless adapter 31 prior to use of the wireless adapter 31. As described above, if the wireless adapter 31 is not used, the hinge cover having no structure for fastening the wireless adapter 31 can be used, preventing degradation in design quality of the refrigerator 1.

(First Modification of Embodiment 1)

Figure 9:
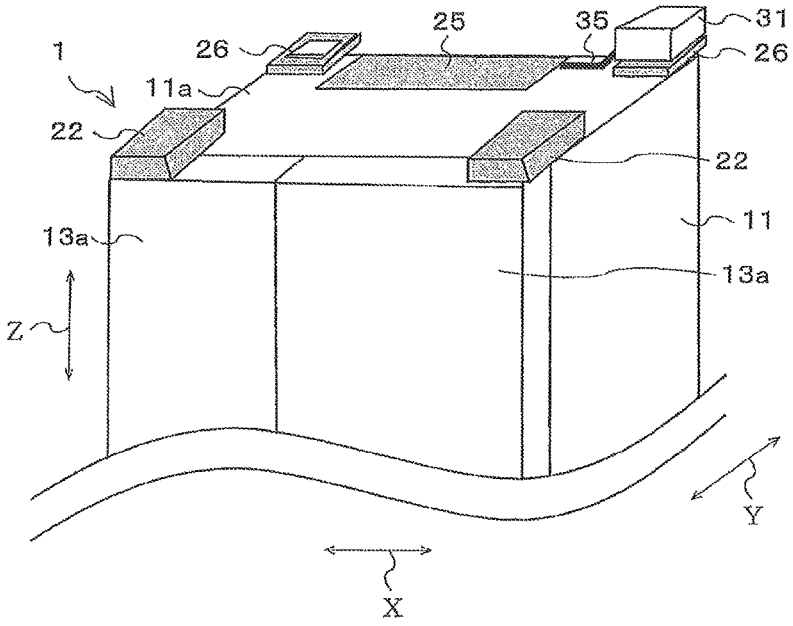
FIG. 9 is a perspective view of a refrigerator 1 according to a first modification of Embodiment 1.

A refrigerator 1 according to a first modification of Embodiment 1 will be described. FIG. 9 is a perspective view of the refrigerator 1 according to the first modification of Embodiment 1. The first modification differs from Embodiment 1 in that the wireless adapter 31 is mounted on the carrying handle 26 attached to the casing 11 of the refrigerator 1. As illustrated in FIG. 9, the carrying handles 26 to be used for carrying the casing 11 are attached to the top surface 11*a* of the casing 11 as in Embodiment 1. The carrying handles 26 are arranged at two corners of the top surface 11*a* of the casing 11 adjacent to the rear surface of the casing 11. In the first modification, the wireless adapter 31 is fastened to an upper surface of one of the carrying handles 26. Since the carrying handles 26 are arranged adjacent to the rear surface of the casing 11, the wireless adapter 31 fastened to the upper surface of the carrying handle 26 is difficult to be noticed when the refrigerator 1 is viewed from the front. As described above, the first modification advantageously enhances the design quality of the refrigerator 1 in addition to achieving the advantages offered by Embodiment 1.

(Second Modification of Embodiment 1)

Figure 10:
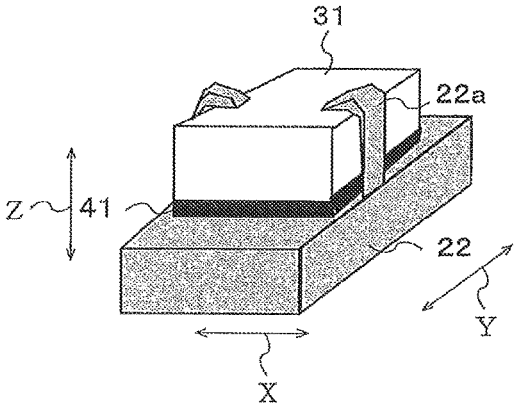
FIG. 10 is a perspective view illustrating the wireless adapter 31 in a second modification of Embodiment 1.

A refrigerator 1 according to a second modification of Embodiment 1 will be described. FIG. 10 is a perspective view illustrating the wireless adapter 31 in the second modification of Embodiment 1. The second modification differs from Embodiment 1 in that a wireless adapter shield 41 is interposed between the wireless adapter 31 and the hinge cover 22 of the refrigerator 1. As illustrated in FIG. 10, the wireless adapter shield 41 is disposed on an attachment surface of the wireless adapter 31 facing the casing 11, that is, the attachment surface of the wireless adapter 31 facing the hinge cover 22. The wireless adapter shield 41 absorbs radio waves and has, for example, a sheet-like shape. Consequently, when the top surface 11*a* of the casing 11 is formed of a steel sheet, the wireless adapter shield 41 reduces reflection of radio waves caused by the steel sheet. The second modification therefore allows further reduction of the influence of the steel sheet on radio waves in addition to achieving the advantages offered by Embodiment 1.

Embodiment 2

Figure 11:
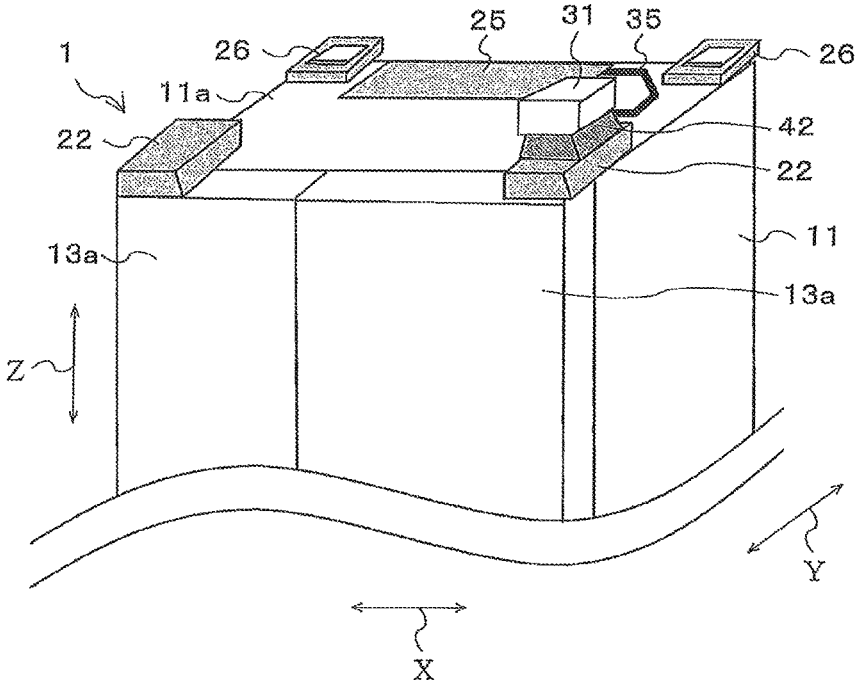
FIG. 11 is a perspective view of a refrigerator 1 according to Embodiment 2.

A refrigerator 1 according to Embodiment 2 will be described. FIG. 11 is a perspective view of the refrigerator 1 according to Embodiment 2. Embodiment 2differs from Embodiment 1 in that an attachment 42 is interposed between the wireless adapter 31 and the hinge cover 22. In Embodiment 2, components common to Embodiment 1 are designated by the same reference signs and an explanation of these components is omitted. The following description will be focused on differences from Embodiment 1.

According to Embodiment 2, as illustrated in FIG. 11, the attachment 42, which is electrically non-conductive, is interposed between the wireless adapter 31 and the hinge cover 22. The attachment 42 is an electrically non-conductive member made of, for example, resin. As regards the manner of fixing the wireless adapter 31 to the attachment 42, the attachment 42 may include claws extending from an upper surface of the attachment 42 to tightly hold the wireless adapter 31. The wireless adapter 31 may be fixed to the attachment 42 with these claws. Alternatively, the wireless adapter 31 may be fixed to the attachment 42 with a screw or a double-faced tape. Furthermore, the claws 22*a* of the hinge cover 22 for tightly holding the wireless adapter 31 may be used as components for fixing the attachment 42 to the hinge cover 22. Alternatively, the attachment 42 may be fixed to the hinge cover 22 with a screw or a double-faced tape.

Since the attachment 42 is interposed between the wireless adapter 31 and the hinge cover 22 as described above, the distance between the hinge cover 22 and the wireless adapter 31 is increased. Consequently, when the top surface 11*a* of the casing 11 is formed of a steel sheet, the distance between the steel sheet and the wireless adapter 31 can be further increased as compared with that in Embodiment 1. The refrigerator 1 allows further reduction of the influence of the steel sheet and accordingly achieves stable radio communication. The hinge covers 22 are detachably attached to the casing 11. Before shipment from a factory, a hinge cover having no fastening structure, such as the claws 22*a*, for fastening the wireless adapter 31 may be attached to the casing 11. This hinge cover can be replaced by the hinge cover 22 having the structure for fastening the wireless adapter 31 prior to use of the wireless adapter 31. As described above, if the wireless adapter 31 is not used, the hinge cover having no structure for fastening the wireless adapter 31 can be used, preventing degradation in design quality of the refrigerator 1 as in Embodiment 1.

(First Modification of Embodiment 2)

Figure 12:
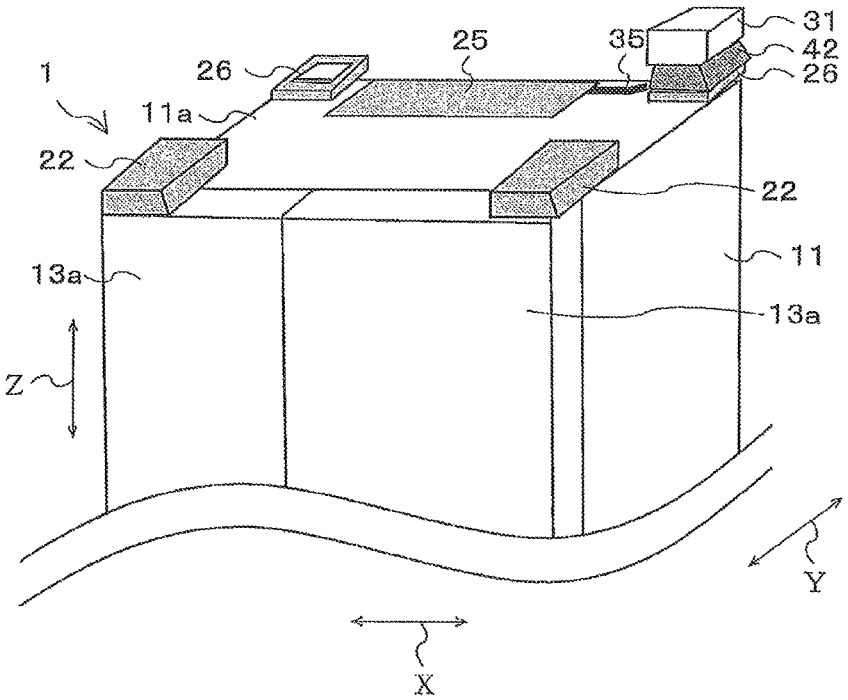
FIG. 12 is a perspective view of a refrigerator 1 according to a first modification of Embodiment 2.

A refrigerator 1 according to a first modification of Embodiment 2 will be described. FIG. 12 is a perspective view of the refrigerator 1 according to the first modification of Embodiment 2. The first modification differs from Embodiment 2 in that, as illustrated in FIG. 12, the wireless adapter 31 is mounted on the carrying handle 26 attached to the casing 11 of the refrigerator 1 and the attachment 42 is interposed between the wireless adapter 31 and the carrying handle 26. Since this carrying handle 26 is disposed adjacent to the rear surface of the casing 11, the wireless adapter 31 and the attachment 42 fastened to the upper surface of the carrying handle 26 are difficult be to noticed when the refrigerator 1 is viewed from the front. As described above, the first modification advantageously enhances the design quality of the refrigerator 1 in addition to achieving the advantages offered by Embodiment 2.

(Second Modification of Embodiment 2)

Figure 13:
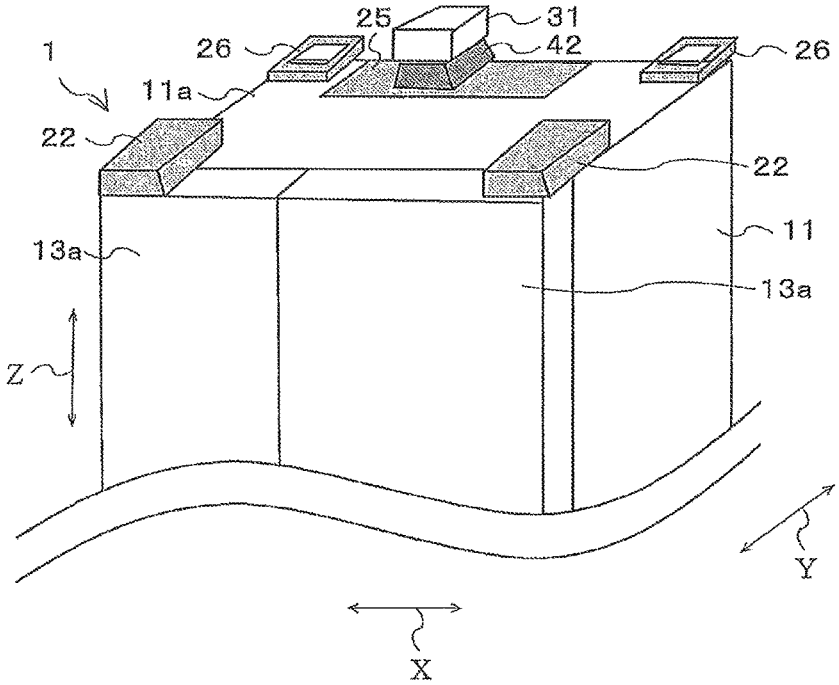
FIG. 13 is a perspective view of a refrigerator 1 according to a second modification of Embodiment 2.

A refrigerator 1 according to a second modification of Embodiment 2 will be described. FIG. 13 is a perspective view of the refrigerator 1 according to the second modification of Embodiment 2. The second modification differs from Embodiment 2 in that the wireless adapter 31 is mounted on the board holder cover 25 attached to the casing 11 of the refrigerator 1 and the attachment 42 is interposed between the wireless adapter 31 and the board holder cover 25. As illustrated in FIG. 13, the board holder cover 25 that covers the board holder 24 holding the control board 23 is attached to the top surface 11*a* of the casing 11 in a manner similar to Embodiments 1 and 2. The board holder cover 25 is disposed on the top surface 11*a* of the casing 11 adjacent to the rear surface of the casing 11. Since the board holder cover 25 is disposed adjacent to the rear surface of the casing 11 as described above, the wireless adapter 31 and the attachment 42 on an upper surface of the board holder cover 25 are difficult to be noticed when the refrigerator 1 is viewed from the front. The second modification advantageously enhances the design quality of the refrigerator 1 in addition to achieving the advantages offered by Embodiment 2.

(Third Modification of Embodiment 2)

Figure 14:
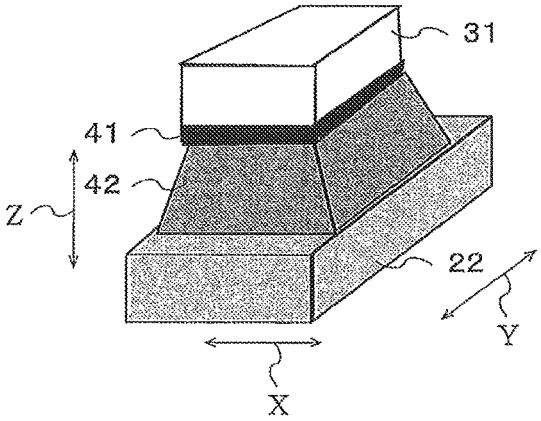
FIG. 14 is a perspective view illustrating the wireless adapter 31 in a third modification of Embodiment 2.

A refrigerator 1 according to a third modification of Embodiment 2 will be described. FIG. 14 is a perspective view illustrating the wireless adapter 31 in the third modification of Embodiment 2. The third modification differs from Embodiment 2 in that the wireless adapter shield 41 is interposed between the wireless adapter 31 and the attachment 42 in the refrigerator 1. As illustrated in FIG. 14, the wireless adapter shield 41 is disposed on the attachment surface of the wireless adapter 31 facing the casing 11, that is, the attachment surface of the wireless adapter 31 facing the attachment 42. The wireless adapter shield 41 absorbs radio waves and has, for example, a sheet-like shape. Consequently, when the top surface 11*a* of the casing 11 is formed of a steel sheet, the wireless adapter shield 41 reduces reflection of radio waves caused by the steel sheet. The third modification therefore allows further reduction of the influence of the steel sheet on radio waves in addition to achieving the advantages offered by Embodiment 2.

(Fourth Modification of Embodiment 2)

Figure 15:
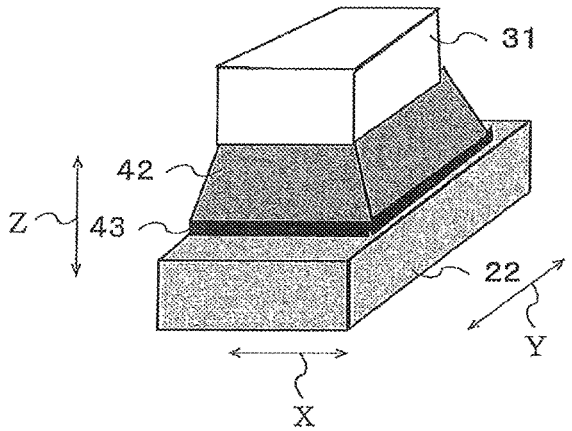
FIG. 15 is a perspective view illustrating the wireless adapter 31 in a fourth modification of Embodiment 2.

A refrigerator 1 according to a fourth modification of Embodiment 2 will be described. FIG. 15 is a perspective view illustrating the wireless adapter 31 in the fourth modification of Embodiment 2. The fourth modification differs from Embodiment 2 in that an attachment shield 43 is interposed between the attachment 42 and the hinge cover 22 of the refrigerator 1. As illustrated in FIG. 15, the attachment shield 43 is disposed on an attachment surface of the attachment 42 facing the casing 11, that is, the attachment surface of the attachment 42 facing the hinge cover 22. Like the wireless adapter shield 41 in the third modification, the attachment shield 43 also absorbs radio waves and has, for example, a sheet-like shape. Consequently, when the top surface 11*a* of the casing 11 is formed of a steel sheet, the attachment shield 43 reduces reflection of radio waves caused by the steel sheet. The fourth modification therefore allows further reduction of the influence of the steel sheet on radio waves in addition to achieving the advantages offered by Embodiment 2.

Embodiment 3

Figure 16:
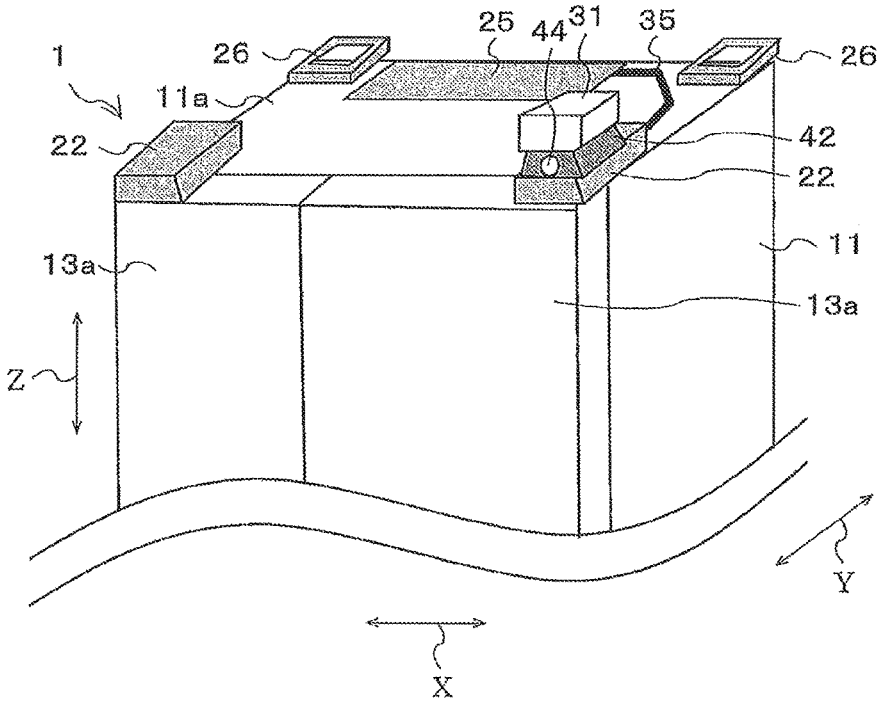
FIG. 16 is a perspective view of a refrigerator 1 according to Embodiment 3.

A refrigerator 1 according to Embodiment 3 will be described. FIG. 16 is a perspective view of the refrigerator 1 according to Embodiment 3. Embodiment 3differs from Embodiment 2 in that the attachment 42 is provided with a lighting unit 44.

In Embodiment 3, components common to Embodiments 1 and 2 are designated by the same reference signs and an explanation of these components is omitted. The following description will be focused on differences from Embodiments 1 and 2.

In Embodiment 3, as illustrated in FIG. 16, the attachment 42 is provided with the lighting unit 44. The lighting unit 44 is provided to illuminate an area around the refrigerator 1. The lighting unit 44 is electrically connected to the control board 23. For example, when the operation panel 16 is operated, or alternatively, when the door switch 14 senses opening of any of the doors 13, the microcontroller 23*a* in the control board 23 transmits an output signal to the lighting unit 44, thus turning on the lighting unit 44. Since the attachment 42 is provided with the lighting unit 44 as described above, the refrigerator 1 advantageously enables an area around the user to be illuminated while the user uses the refrigerator 1, even if the user does not turn on a lighting device for a room where the refrigerator 1 is installed, in addition to providing the advantages offered by Embodiments 1 and 2.

Embodiment 4

Figure 17:
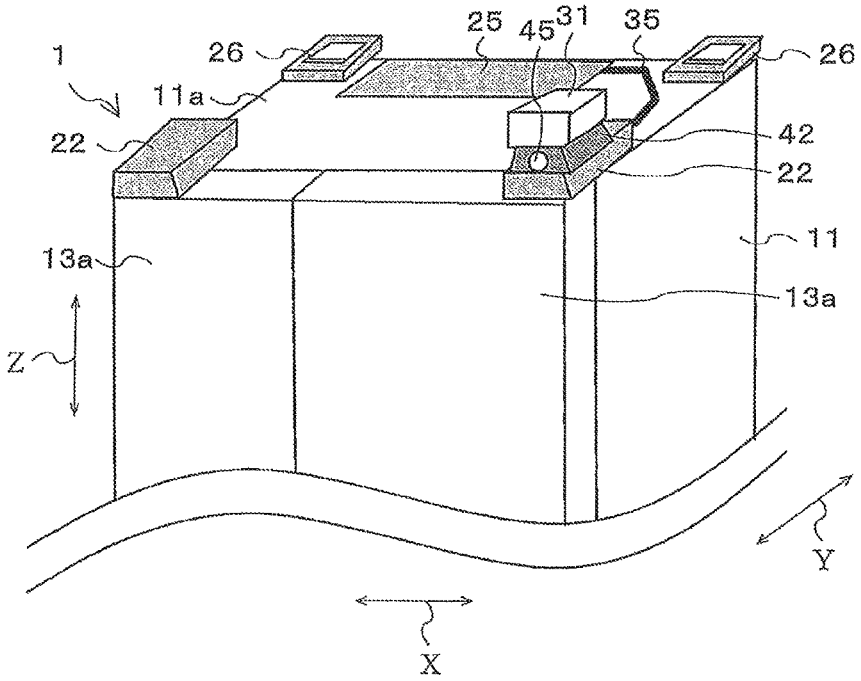
FIG. 17 is a perspective view of a refrigerator 1 according to Embodiment 4.

A refrigerator 1 according to Embodiment 4 will be described. FIG. 17 is a perspective view of the refrigerator 1 according to Embodiment 4. Embodiment 4 differs from Embodiments 2 and 3 in that the attachment 42 is provided with a camera 45. In Embodiment 4, components common to Embodiments 1, 2, and 3 are designated by the same reference signs and an explanation of these components is omitted. The following description will be focused on differences from Embodiments 1, 2, and 3.

In Embodiment 4, as illustrated in FIG. 17, the attachment 42 is provided with the camera 45. The camera 45 is provided to capture an image of the area around the refrigerator 1. The camera 45 is electrically connected to the control board 23. The user can view an image captured by the camera 45 on the information terminal 7 connected to the household appliance networking system 2 through the wireless adapter 31 connected to the control board 23 and the central controller 3. Since the attachment 42 is provided with the camera 45 as described above, the refrigerator 1 enables the user to check the area around the refrigerator 1, for example, the kitchen where the refrigerator 1 is installed while the user is in a room other than the room where the refrigerator 1 is installed or while the user is on the go.

In addition to the camera 45, the attachment 42 may be provided with the lighting unit 44 as in Embodiment 3. In this case, the lighting unit 44 can illuminate the area around the refrigerator 1 when the camera 45 captures an image of the area around the refrigerator 1. Advantageously, a clear image of the area around the refrigerator 1 can be captured during dark time, for example, at night. Consequently, the user can more clearly check the area around the refrigerator 1, for example, the kitchen where the refrigerator 1 is installed.

Embodiment 5

Figure 18:
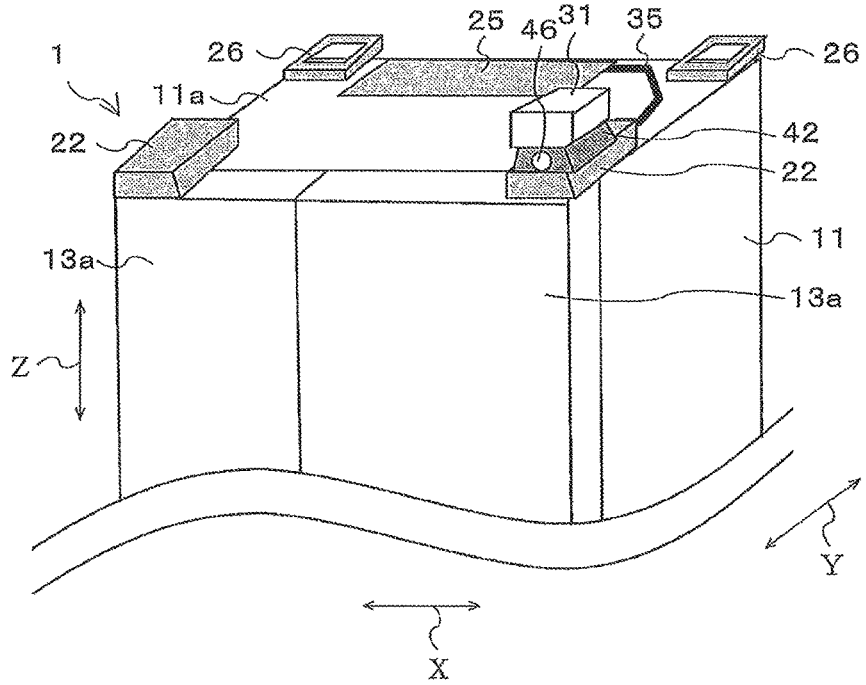
FIG. 18 is a perspective view of a refrigerator 1 according to Embodiment 5.

A refrigerator 1 according to Embodiment 5 will be described. FIG. 18 is a perspective view of the refrigerator 1 according to Embodiment 5. Embodiment 5 differs from Embodiments 2, 3, and 4 in that the attachment 42 is provided with a human presence sensor 46. In Embodiment 5, components common to those in Embodiments 1, 2, 3, and 4 are designated by the same reference signs and an explanation of these components is omitted. The following description will be focused on differences from Embodiments 1, 2, 3, and 4.

In Embodiment 5, as illustrated in FIG. 18, the attachment 42 is provided with the human presence sensor 46. The human presence sensor 46 senses the presence of a person in the area around the refrigerator 1. The human presence sensor 46 is electrically connected to the control board 23. When a person approaches the refrigerator 1, the human presence sensor 46 senses the person. Consequently, the user can check the person approaching the refrigerator 1 by using the information terminal 7 connected to the household appliance networking system 2 through the wireless adapter 31 connected to the control board 23 and the central controller 3.

In addition to the human presence sensor 46, the attachment 42 may be provided with the lighting unit 44 as in Embodiment 3. In this case, when the human presence sensor 46 senses a person approaching the refrigerator 1, the lighting unit 44 can illuminate the area around the refrigerator 1. If a person other than the user, for example, a burglar, approaches the refrigerator 1, the human presence sensor 46 will sense the burglar and the lighting unit 44 will be turned on, thereby causing the burglar to feel someone in the house, enabling enhancement of security.

Furthermore, in addition to the human presence sensor 46, the attachment 42 may be provided with the camera 45 as in Embodiment 4. In this case, when the human presence sensor 46 senses a person approaching the refrigerator 1, the camera 45 is activated. Consequently, the user can check the area around the refrigerator 1, for example, the kitchen where the refrigerator 1 is installed while the user is in a room other than the room where the refrigerator 1 is installed or while the user is on the go. Additionally, in addition to the human presence sensor 46, the attachment 42 may be provided with the lighting unit 44 and the camera 45. In this case, when the human presence sensor 46 senses a person approaching the refrigerator 1 during dark time, for example, at night, the lighting unit 44 provides illumination, so that the user can more clearly check the area around the refrigerator 1, for example, the kitchen where the refrigerator 1 is installed while the user is in a room other than the room where the refrigerator 1 is installed or while the user is on the go.

REFERENCE SIGNS LIST

1 refrigerator 2 household appliance networking system 3 central controller 4 air conditioning apparatus 5 photovoltaic panel 6 electric car

7 information terminal 8 external network 11 casing 11*a* top surface 12 storage compartment 12*a* refrigerating compartment l2*b* ice making compartment 12*c* first freezer compartment 12*d* second freezer compartment 12*e* vegetable compartment 13 door 13*a* refrigerating compartment door 13*b* ice making compartment door 13*c* first freezer compartment door 13*d* second freezer compartment door 13*e* vegetable compartment door 14 door switch 15 refrigerator light 16 operation panel

17 cooling room 18 cooling device 18*a* compressor 18*b* cooler 18*c* refrigerator fan 19 damper 20 temperature sensor 21 hinge 22 hinge cover 22*a* claw 23 control board 23*a* microcontroller 23*b* board connector 24 board holder 25 board holder cover 26 carrying handle 31 wireless adapter 32 antenna unit 33 communication board 34 communication case 34*a* protrusion 34*b* screw hole 34*ba* screw 35 communication line 36 adapter connector 41 wireless adapter shield 42 attachment 43 attachment shield 44 lighting unit 45 camera 46 human presence sensor

The invention claimed is:

1. A refrigerator comprising:

a casing including a storage compartment;

a door attached to the casing to expose or cover the storage compartment;

a hinge connecting the door to the casing and supporting the door so that the door is openable and closable;

an electrically non-conductive hinge cover detachably attached to the casing, wherein the hinge cover covers the hinge;

a wireless adapter disposed on the hinge cover, wherein the wireless adapter includes an antenna unit configured to transmit and receive radio waves; and an electrically non-conductive attachment interposed between the hinge cover and the wireless adapter to increase a distance between the hinge cover and the wireless adapter and fix the hinge cover and the wireless adapter.

2. The refrigerator of claim 1, further comprising a lighting unit provided for the attachment, wherein the lighting unit is configured to illuminate a surrounding area.

3. The refrigerator of claim 1, further comprising a camera provided for the attachment, wherein the camera captures an image of a surrounding area.

4. The refrigerator of claim 1, further comprising a human presence sensor provided for the attachment, wherein the human presence sensor senses a presence of a person in a surrounding area.

5. The refrigerator of claim 1, further comprising an attachment shield disposed on an attachment surface of the attachment facing the casing, wherein the attachment shield absorbs radio waves.

6. The refrigerator of claim 1, further comprising a wireless adapter shield disposed on an attachment surface of the wireless adapter facing the casing, wherein the wireless adapter shield absorbs radio waves.

7. A household appliance networking system comprising:

the refrigerator of claim 1;

an electrical apparatus; and a central controller configured to control the refrigerator and the electrical apparatus, wherein the refrigerator and the electrical apparatus are connected through the central controller.

8. The refrigerator of claim 1, wherein the wireless adaptor is mounted on a top surface of the hinge cover.

9. The refrigerator of claim 1, wherein the wireless adaptor is located on an upper surface of the hinge cover.

10. The refrigerator of claim 1, wherein the wireless adaptor is fastened to the hinge cover.

* * * * *